US011326786B2

(12) United States Patent
Kim et al.

(10) Patent No.: US 11,326,786 B2
(45) Date of Patent: May 10, 2022

(54) AIR CONDITIONER

(71) Applicant: SAMSUNG ELECTRONICS CO., LTD., Suwon-si (KR)

(72) Inventors: Mun Sub Kim, Suwon-si (KR); Hyeong Joon Seo, Suwon-si (KR); Hyeong Jin Lee, Suwon-si (KR); Du Han Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/210,783

(22) Filed: Dec. 5, 2018

(65) Prior Publication Data

US 2019/0170374 A1 Jun. 6, 2019

(30) Foreign Application Priority Data

Dec. 5, 2017 (KR) ..... 10-2017-0165910
Nov. 27, 2018 (KR) ..... 10-2018-0148901

(51) Int. Cl.
*F24F 1/26* (2011.01)
*F24F 13/00* (2006.01)
(Continued)

(52) U.S. Cl.
CPC ..... *F24F 1/26* (2013.01); *F24F 13/00* (2013.01); *F24F 13/02* (2013.01); *F25B 1/04* (2013.01);
(Continued)

(58) Field of Classification Search
CPC ..... F24F 1/26; F24F 1/30; F24F 1/32; F25B 41/003; F25B 2500/01; F25B 2500/17;
(Continued)

(56) References Cited

U.S. PATENT DOCUMENTS

2005/0172656 A1 8/2005 Jung et al.
2005/0178140 A1* 8/2005 Jung ..... F25B 31/00 62/295
(Continued)

FOREIGN PATENT DOCUMENTS

CN 101298953 11/2008
CN 102667276 * 9/2012
(Continued)

OTHER PUBLICATIONS

English Abstractor of JP2005-214615 (Year: 2005).*
(Continued)

*Primary Examiner* — Andrew D StClair
(74) *Attorney, Agent, or Firm* — Staas & Halsey LLP

(57) ABSTRACT

An air conditioner comprises a compressor configured to have an inlet, through which a refrigerant is sucked in, the sucked refrigerant being compressed by the compressor, and an outlet, through which the compressed refrigerant is discharged, a four-way valve configured to switch flow paths in cooling and heating operations, the four-way valve having a valve body, a D port protruding from the valve body in a first direction to be connected to the outlet, and an S port 26 protruding from the valve body in a second direction, which is opposite to the first direction, to be connected to the inlet, and a compressor pipe having a discharging pipe to connect the outlet and the D port and a sucking pipe to connect the inlet and the S port, one of the discharging pipe and the sucking pipe has two curved portions and the other has one curved portion.

20 Claims, 18 Drawing Sheets

(51) Int. Cl.

| | |
|---|---|
| ***F25B 1/04*** | (2006.01) |
| ***F25B 13/00*** | (2006.01) |
| ***F24F 13/02*** | (2006.01) |
| ***F25B 41/40*** | (2021.01) |
| *F25B 41/20* | (2021.01) |

(52) U.S. Cl.
CPC ..... *F25B 13/00* (2013.01); *F25B 41/40* (2021.01); *F25B 41/20* (2021.01); *F25B 2313/006* (2013.01); *F25B 2313/02741* (2013.01); *F25B 2500/01* (2013.01); *F25B 2500/05* (2013.01); *F25B 2500/13* (2013.01); *F25B 2500/17* (2013.01)

(58) Field of Classification Search
CPC .. F25B 2313/02741; F25B 2313/02742; F25B 2313/02743
See application file for complete search history.

(56) References Cited

U.S. PATENT DOCUMENTS

| | | | | |
|---|---|---|---|---|
| 2005/0183436 | A1* | 8/2005 | Jung | F16L 55/02 62/295 |
| 2007/0039346 | A1* | 2/2007 | Yano | F25B 41/003 62/295 |
| 2010/0116461 | A1* | 5/2010 | Saito | F28F 1/40 165/62 |
| 2015/0020539 | A1* | 1/2015 | Park | C09K 5/045 62/498 |
| 2017/0191680 | A1* | 7/2017 | Song | F16K 11/065 |

FOREIGN PATENT DOCUMENTS

| | | | |
|---|---|---|---|
| JP | 09-152232 | * | 6/1997 |
| JP | 2005-214615 | * | 8/2005 |
| KR | 10-2001-0026762 | | 4/2001 |
| KR | 10-2004-0044642 | | 5/2004 |
| KR | 1005930840000 | | 6/2006 |
| KR | 1007103540000 | | 4/2007 |
| KR | 10-2007-0080138 | | 8/2007 |
| KR | 10-2008-0020769 | | 3/2008 |
| KR | 10-2011-0083346 | | 7/2011 |
| KR | 20110083346 A | | 7/2011 |
| WO | 2017/082321 | | 5/2017 |

OTHER PUBLICATIONS

English Machine Translation of Nagano JP 09-152232.*
English translation of CN 102667276, retrieved Jul. 22, 2021, original document published Sep. 2012.*
International Search Report dated Apr. 8, 2019 in corresponding International Patent Application No. PCT/KR2018/015274 (3 pages).
Extended European Search Report dated Apr. 3, 2019 in corresponding European Patent Application No. 18210263.2 (7 pages).
Chinese Office Action dated May 6, 2021 in Chinese Patent Application No. 201811482348.3.
Chinese Office Action dated Oct. 22, 2021, for Chinese Patent Application No. 2018114823483 (3 pages including translation).
Office Action dated Feb. 25, 2022 issued in India Application No. 202017028061.

* cited by examiner

AIR CONDITIONER

CROSS-REFERENCE TO RELATED APPLICATION

This application is based on and claims priority under 35 U.S.C. § 119 to Korean Patent Application No. 10-2017-0165910 filed on Dec. 5, 2017 and 10-2018-0148901 filed on Nov. 27, 2018, in the Korean Intellectual Property Office, the disclosure of which is incorporated herein by reference in its entirety.

BACKGROUND

1. Field

The present disclosure relates to an air conditioner, and more particularly, to a piping structure of an air conditioner.

2. Discussion of Related Art

An air conditioner is equipped with a compressor, a condenser, an expansion valve, an evaporator, a blower fan, and the like, for controlling indoor temperature, humidity, air currents, etc., using refrigeration cycles. The air conditioner may include an indoor unit placed indoors and an outdoor unit placed outdoors.

The outdoor unit includes a compressor, an outdoor heat exchanger, a blower, an expansion mechanism, a four-way valve, and the like. The four-way valve switches the flow path in the cooling mode and the heating mode of the air conditioner.

The four-way valve has four ports coupled to inlet and outlet of the compressor, an indoor heat exchanger and the outdoor heat exchanger through pipes, respectively. In this structure, vibrations generated in the compressor while the compressor is operating are transmitted to the pipes, and may be reduced or amplified depending on the length, shape, density, etc., of the pipes. Especially, when the operation frequency of the compressor and the natural frequency of the pipe are matched, resonance occurs in the pipe, leading to a significant increase in vibrations and probably making cracks in the pipe.

SUMMARY

The present disclosure provides an air conditioner having a piping structure capable of reducing vibrations in the pipe to secure reliability of the piping structure.

The present disclosure also provides an air conditioner having a piping structure capable of minimizing the length of pipes to reduce material costs and attain a compact compressor room.

In accordance with an aspect of the present disclosure, an air conditioner includes a compressor configured to have an inlet, through which a refrigerant is sucked in, the sucked refrigerant being compressed by the compressor, and an outlet, through which the compressed refrigerant is discharged; a four-way valve configured to switch flow paths in a cooling operation and a heating operation, the four-way valve having a valve body, a D port protruding from the valve body in a first direction to be connected to the outlet, and an S port 26 protruding from the valve body in a second direction, which is opposite of the first direction, to be connected to the inlet; and a compressor pipe having a discharging pipe to connect the outlet and the D port and a sucking pipe to connect the inlet and the S port, one of the discharging pipe and the sucking pipe has two curved portions and an other one of the discharging pie and the sucking pipe has one curved portion.

A center axis of the D port and a center axis of the S port may be included in a plane including a center axis of the inlet and a center axis of the outlet.

A center axis of the D port and a center axis of the S port may be formed at an angle with respect to a plane including a center axis of the inlet and a center axis of the outlet.

A center axis of the inlet and a center axis of the outlet may be parallel to each other.

A center axis of the D port and a center axis of the S port may correspond to each other.

The valve body may have a cylindrical shape, and the D port and the S port may protrude in directions perpendicular to an axial direction of the valve body.

The D port and the S port may respectively protrude from a center portion of the valve body.

The four-way valve may be slantingly arranged such that the D port is positioned higher than the S port.

The discharging pipe may include a first linear pipe portion coupled to the D port, a second linear pipe portion coupled to the outlet, a third linear pipe portion extending between the first linear pipe portion and the second linear pipe portion, a first curved pipe portion to connect the first and third linear pipe portions, and a second curved pipe portion to connect the second and third linear pipe portions.

The sucking pipe may include a first linear pipe portion coupled to the S port, a second linear pipe portion coupled to the inlet, and a curved pipe portion to connect the first linear pipe portion and the second linear pipe portion.

The four-way valve may be slantingly arranged such that the S port is positioned higher than the D port.

The S port and the D port may be positioned at a corresponding height.

In another aspect of the present disclosure, an air conditioner includes a compressor configured to have an inlet, through which a refrigerant is sucked in, the sucked refrigerant being compressed by the compressor, and an outlet, through which the compressed refrigerant is discharged; an outdoor heat exchanger and an indoor heat exchanger; and a four-way valve configured to switch flow paths in a cooling operation and a heating operation, the four-way valve having a D port coupled to the outlet, an S port coupled to the inlet, a C port coupled to the outdoor heat exchanger, and an E port coupled to the indoor heat exchanger, wherein the D port is directly coupled to the outlet or the S port is directly coupled to the inlet.

The S port may be inserted and coupled to the inlet.

The four-way valve may include a valve body having a cylindrical shape, the D port may protrude in a first direction, which is perpendicular to an axial direction of the valve body, and the S port may include a first linear port portion protruding in a second direction opposite to the first direction, a second linear port portion coupled to the inlet, and a curved port portion to connect the first and second linear port portions.

The first linear port portion and the second linear port portion may form an angle of about 20 degrees to about 90 degrees.

The air conditioner may further include an outdoor heat exchanger pipe to connect the outdoor heat exchanger and the C port, wherein the C port may include a fourth linear port portion parallel to the first linear port portion, a fifth linear port portion coupled to the outdoor heat exchanger pipe, and a second curved port portion to connect the fourth linear pipe portion and the fifth linear port portion, and wherein the second curved port portion may bent in an opposite direction of the curved port portion.

The air conditioner may further include an indoor heat exchanger pipe to connect the indoor heat exchanger and the E port, wherein the E port may include a fourth linear port portion parallel to the first linear port portion, a fifth linear port portion coupled to the indoor heat exchanger pipe, and a second curved port portion to connect the fourth linear pipe portion and the fifth linear port portion, and wherein the second curved port portion may be bent in an opposite direction of the curved port portion.

The D port may be inserted and coupled to the outlet.

The four-way valve may include a valve body having a cylindrical shape, and the D port may include a first linear port portion protruding in a first direction perpendicular to an axial direction of the valve body, a second linear port portion coupled to the outlet, and a curved port portion to connect the first linear pipe portion and the second linear port portion.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
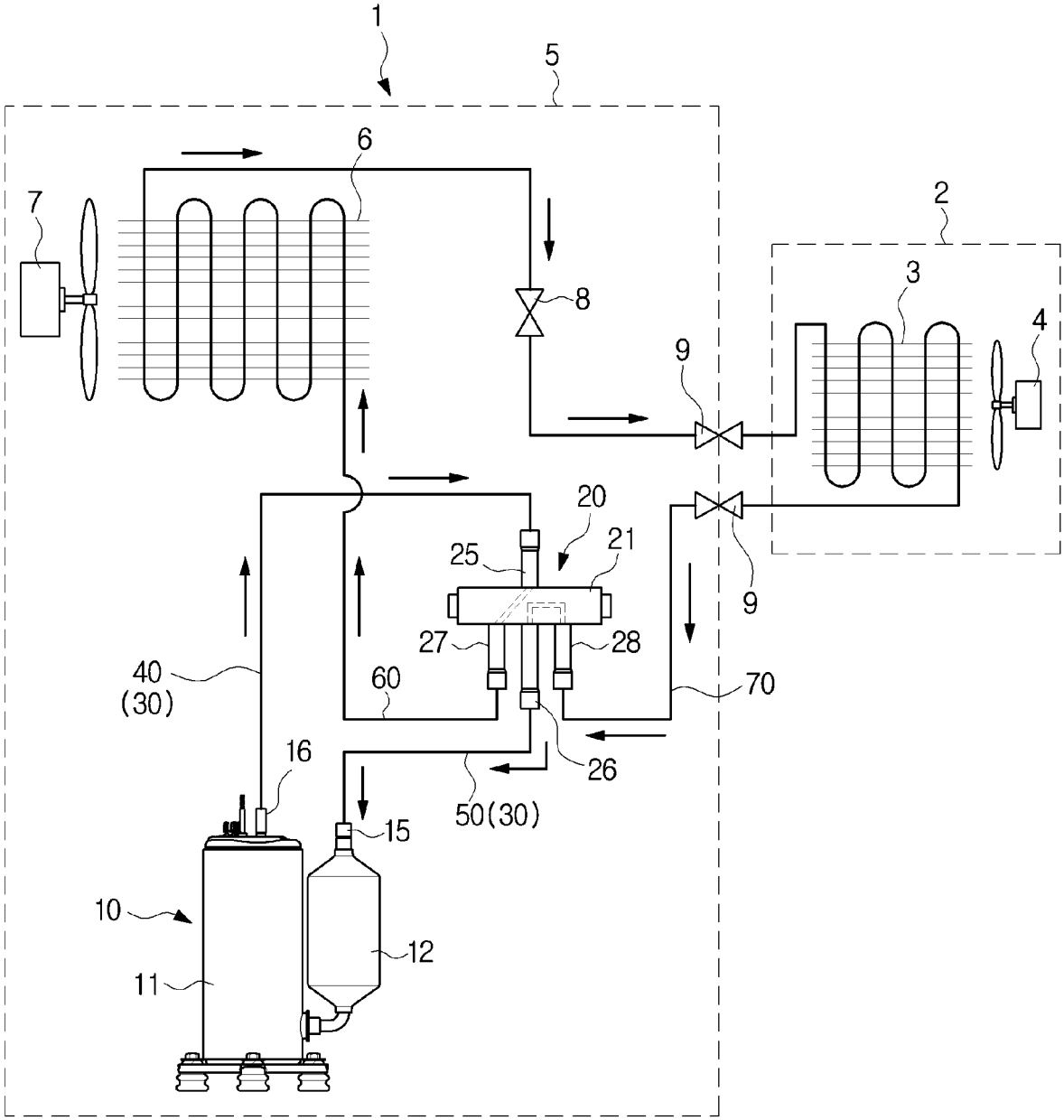
FIGS. 1 and 2 are refrigerant circuits of an air conditioner in cooling and heating operation modes, respectively, according to a first embodiment of the present disclosure.

Embodiments of the present disclosure are only the most preferred examples and provided to assist in a comprehensive understanding of the disclosure as defined by the claims and their equivalents. Accordingly, those of ordinary skilled in the art will recognize that various changes and modifications of the embodiments described herein can be made without departing from the scope and spirit of the disclosure.

It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another.

Reference will now be made in detail to embodiments, examples of which are illustrated in the accompanying drawings, wherein like reference numerals refer to the like elements throughout.

Figure 2:
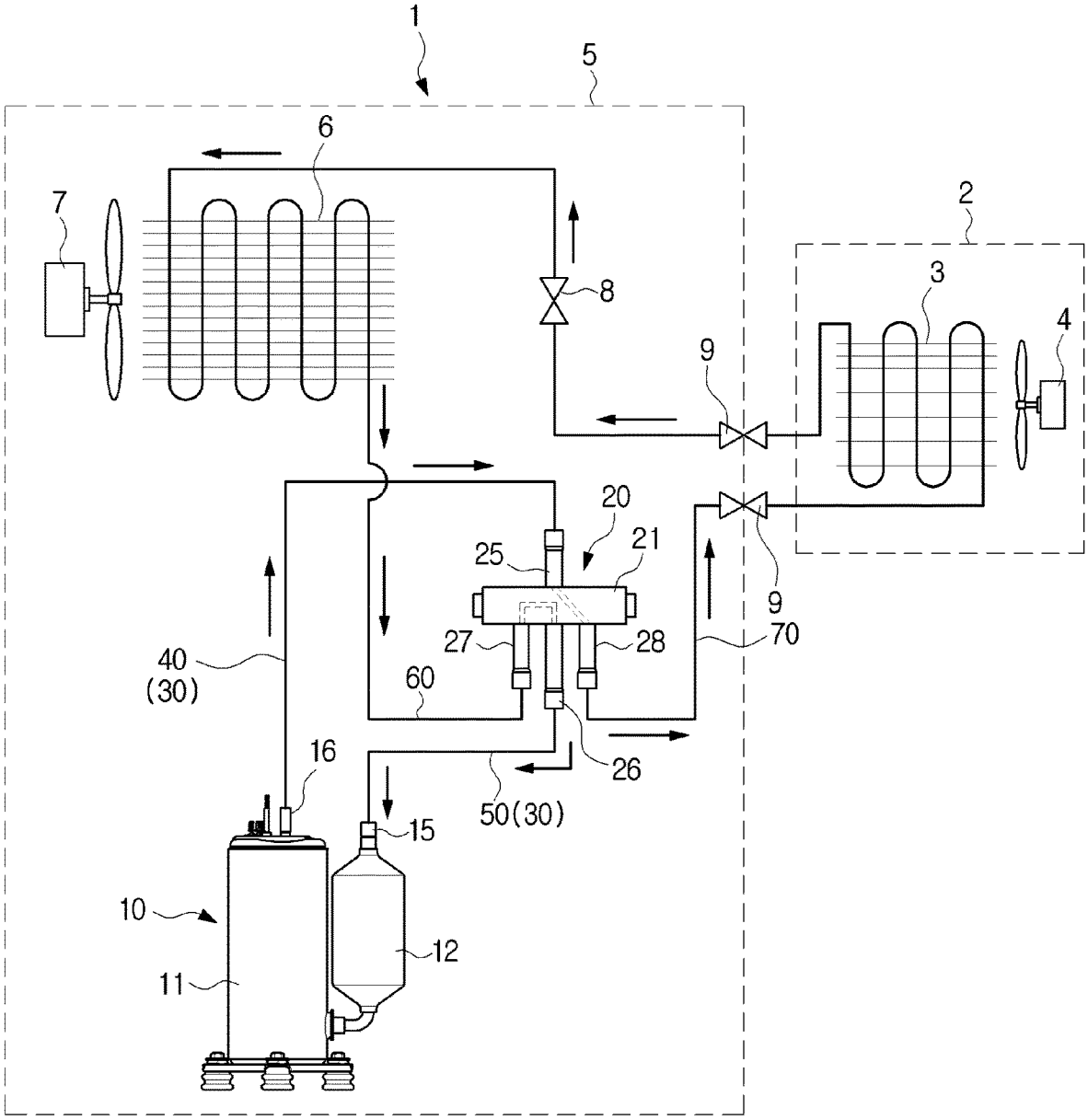

FIGS. 1 and 2 are refrigerant circuits of an air conditioner in cooling and heating operation modes, respectively, according to a first embodiment of the present disclosure.

Referring to FIGS. 1 and 2, an air conditioner 1 includes an indoor unit 2, an outdoor unit 5, and pipes connecting the indoor unit 2 and the outdoor unit 5.

The indoor unit 2 may include an indoor heat exchanger 3 and a blower 4, and the outdoor unit 5 may include an outdoor heat exchanger 6, a blower 7, a compressor 10, an expansion mechanism 8, a four-way valve 20, and service valves 9.

The compressor 10 may include a single inverter compressor with the compressing capacity varying by input frequency, or a combination of a plurality of constant rate compressors with the constant compressing capacity.

The compressor 10 may include a compressor body 11 having a driver and a compressing unit, and an accumulator 12 for filtering the liquid refrigerant off from the refrigerant flowing to the compressor body 11. The compressor body 11 may be a rotary compressor. The compressor 10 may be equipped with an inlet 15 through which the refrigerant is sucked in, and an outlet 16 through which the refrigerant sucked in and compressed by the compressor is discharged. The accumulator 12 may provide a refrigerant resulting from filtering off of the liquid refrigerant from refrigerants flowing to the compressor 10 from the four-way valve 20, i.e., a refrigerant gas, to the compressor body 11.

The indoor heat exchanger 3 may act as an evaporator during the cooling mode as shown in FIG. 1, and as a condenser during the heating mode as shown in FIG. 2. The outdoor heat exchanger 6 may act as a condenser during the cooling mode as shown in FIG. 1, and as an evaporator during the heating mode as shown in FIG. 2.

The expansion mechanism 8 may expand the refrigerant passing between the indoor heat exchanger 3 and the outdoor heat exchanger 6. The expansion mechanism 8 may include an electronic expansion valve with a varying opening to be able to control the amount of the refrigerant.

The service valve 9 may be installed in the pipe to connect the pipe on the side of the indoor unit 2 and the pipe on the side of the outdoor unit 5 and fill the pipe with the refrigerant.

The four-way valve 20 may switch the flow path to change flows of the refrigerant according to the user's choice. In other words, the four-way valve 20 may guide the refrigerant discharged from the compressor 10 to the indoor heat exchanger 3 or the outdoor heat exchanger 6.

The four-way valve 20 may include a valve body 21 and four ports 25, 26, 27, and 28 protruding from the valve body 21. The four ports 25, 26, 27, and 28 may include a D port 25 formed to be coupled to the outlet 16 of the compressor 10, an S port 26 formed to be coupled to the inlet 15 of the compressor 10, a C port 27 formed to be coupled to the outdoor heat exchanger 6, and an E port 28 formed to be coupled to the indoor heat exchanger 3.

The four-way valve 20 may switch flows of the refrigerant by having the D port 25 and the C port 27 connected and the S port 26 and the E port 28, respectively, connected in the cooling mode of FIG. 1, and having the D port 25 and the E port 28 connected and the S port 26 and the C port 27, respectively, connected in the heating mode of FIG. 2.

In other words, in the cooling mode of FIG. 1, when the D port 25 and the C port 27 are connected while the S port 26 and the E port 28 are connected, the refrigerant that has flowed into the four-way valve 20 from the compressor 10 flows out to the outdoor heat exchanger 6 and the refrigerant that has flowed into the four-way valve 20 from the indoor heat exchanger 3 flows out to the compressor 1.

In other words, in the heating mode of FIG. 2, when the D port 25 and the E port 28 are connected while the S port 26 and the C port 27 are connected, the refrigerant that has flowed into the four-way valve 20 from the compressor 10 flows out to the indoor heat exchanger 3 and the refrigerant that has flowed into the four-way valve 20 from the outdoor heat exchanger 6 flows out to the compressor 1.

The pipes of the air conditioner 1 may include a compressor pipe 30 connecting the compressor 2 and the four-way valve 20, an outdoor heat exchanger pipe 60 connecting the outdoor heat exchanger 6 and the four-way valve 20, and an indoor heat exchanger pipe 70 connecting the indoor heat exchanger 3 and the four-way valve 20. The compressor pipe 30 may include a discharging pipe 40 connecting the outlet 16 of the compressor 10 and the D port 25 of the four-way valve 20, and a sucking pipe 50 connecting the inlet 15 of the compressor 10 and the S port 26 of the four-way valve 20.

There is an attempt to elongate the pipe 30 or form the pipe 30 into a loop to alleviate vibrations in the pipe when the compressor 10 is operating, in which case, however, the material cost might rise and the piping structure becomes complicated, thereby taking up a large area of the compressor space. Furthermore, since modern air conditioners mainly use an inverter compressor with a varying range of operation, the attempted structure makes it difficult to design the natural frequency of the pipe to go beyond the wide range of operation of the inverter compressor.

However, the piping structure of the air conditioner in accordance with embodiments of the disclosure may secure reliability of the pipe cohesion, save material costs, and attain a compact compressor room by connecting the four-way valve 20 closely or directly to the compressor 10 to shift the natural frequency of the pipe out of the operating range of the compressor 10. Structures of pipes and the four-way valve 20 of the air conditioner in accordance with embodiments of the present disclosure will now be described in detail.

Figure 3:
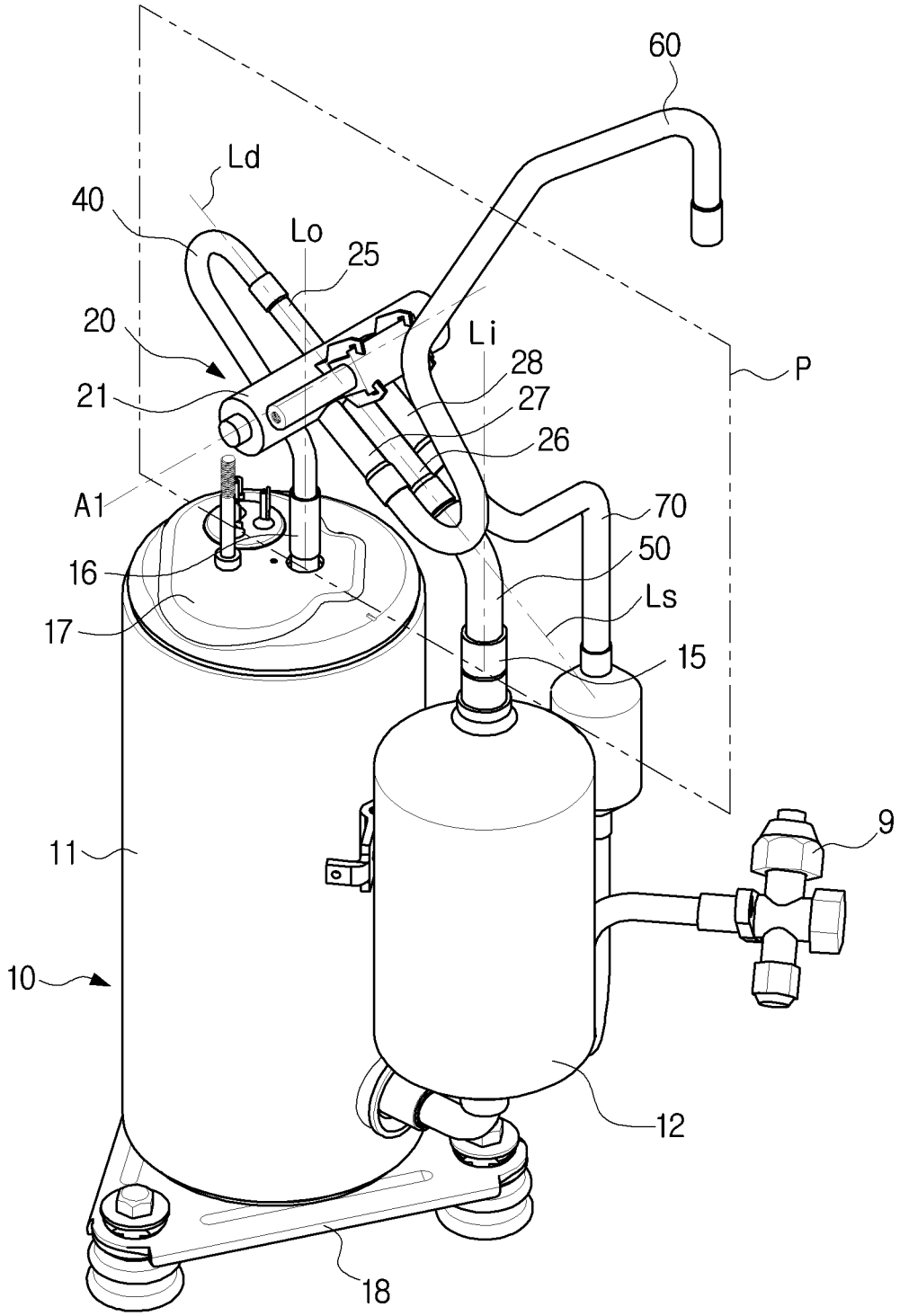
FIG. 3 is a perspective view of a piping structure connecting a compressor and a four-way valve, according to the first embodiment of the present disclosure.
Figure 4:
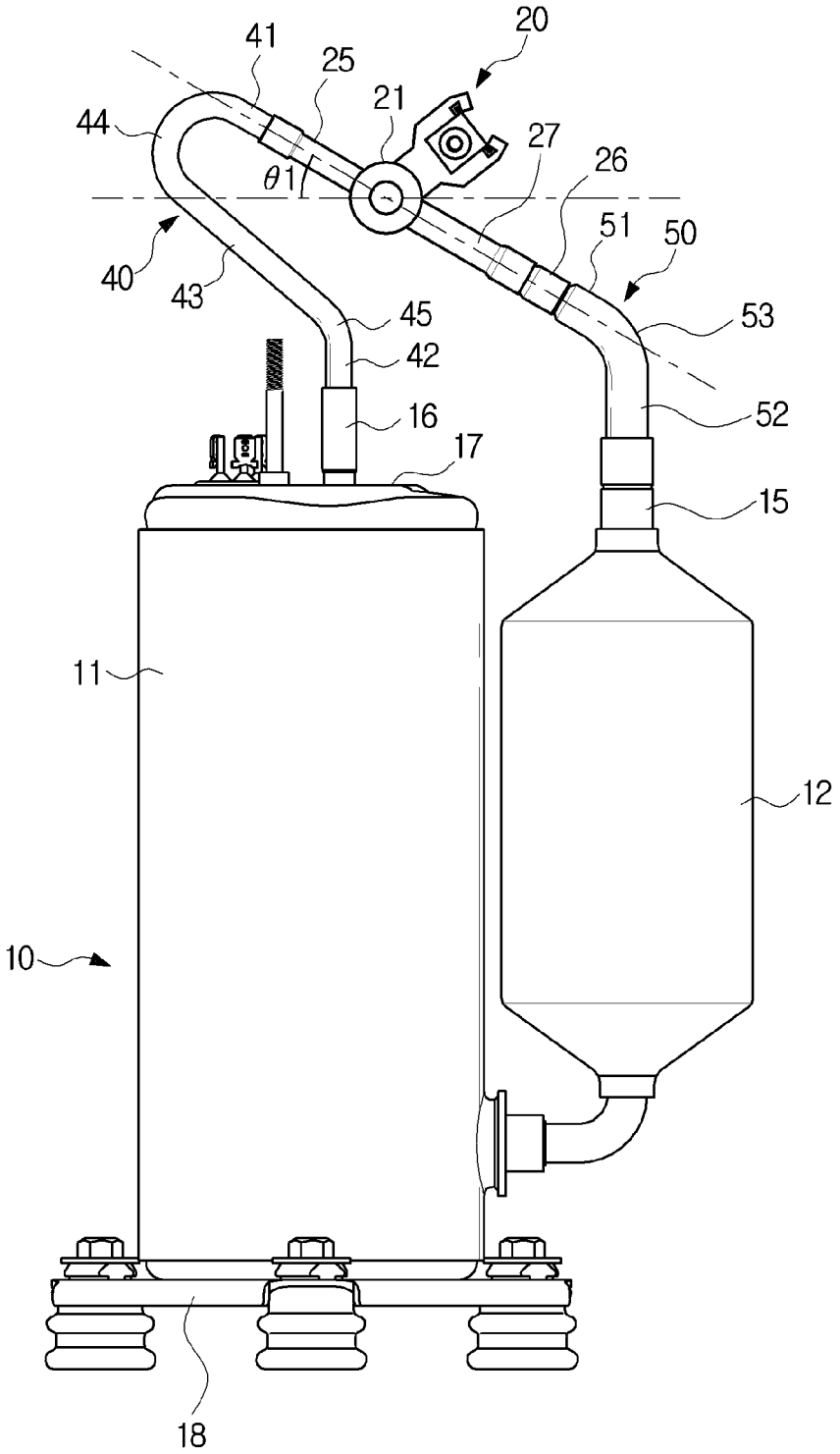
FIG. 4 is a side view of the piping structure connecting the compressor and the four-way valve, according to the first embodiment of the present disclosure.
Figure 5:
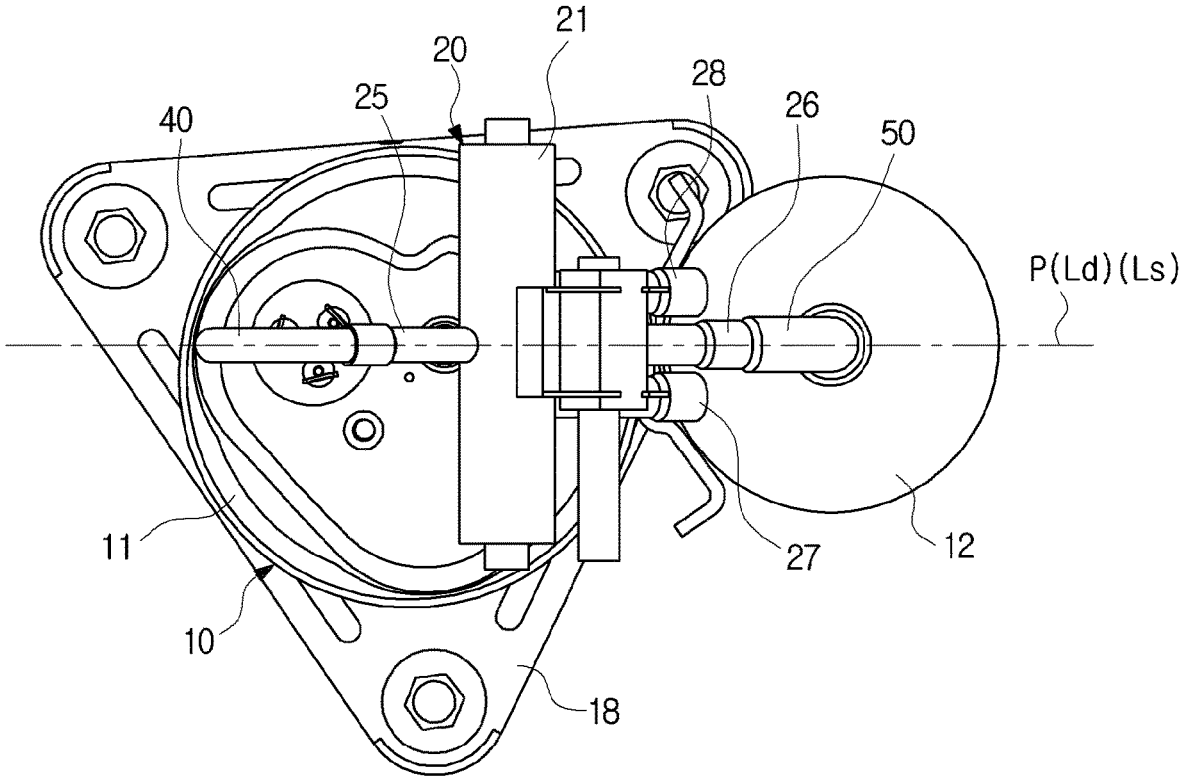
FIG. 5 is a plan view of the piping structure connecting the compressor and the four-way valve, according to the first embodiment of the present disclosure.

FIG. 3 is a perspective view of a piping structure connecting a compressor and a four-way valve, according to the first embodiment of the present disclosure. FIG. 4 is a side view of the piping structure connecting the compressor and the four-way valve, according to the first embodiment of the present disclosure. FIG. 5 is a plan view of the piping structure connecting the compressor and the four-way valve, according to the first embodiment of the present disclosure. For convenience of explanation, the outdoor heat exchanger pipe 60 and the indoor heat exchanger pipe 70 are omitted in FIGS. 4 and 5.

As shown in FIGS. 3 to 5, the compressor 10 is placed on a supporter 18, and may have a flat top face 17. The compressor 10 may have the inlet 15 through which the refrigerant is sucked in, and the outlet 16 through which the refrigerant sucked in and compressed, by the compressor is discharged, and the inlet 15 and the outlet 16 may have the form that substantially vertically protrudes from the top face 17.

The center axis Li of the inlet 15 and the center axis Lo of the outlet 16 may be substantially parallel to each other. In other words, the center axis Li of the inlet 15 and the center axis Lo of the outlet 16 may be on the same plane P.

The four-way valve 20 may include the valve body 21 and the four ports 25, 26, 27, and 28 protruding from the valve body 21. The four ports 25, 26, 27, and 28 may include the D port 25 formed to be coupled to the outlet 16 of the compressor 10, the S port 26 formed to be coupled to the inlet 15 of the compressor 10, the C port 27 formed to be coupled to the outdoor heat exchanger 6, and the E port 28 formed to be coupled to the indoor heat exchanger 3.

The valve body 21 may have a cylindrical shape. The valve body 21 may be elongated in an axial direction A1. The D port 25 may protrude from the valve body 21 in a first direction which is perpendicular to the axial direction A1. The S port 26 may protrude from the valve body 21 in a second direction which is opposite of the first direction. Accordingly, the center axis Ld of the D port 25 and the center axis Ls of the S port 26 may be on the same straight line. In other words, the center axis Ld of the D port 25 and the center axis Ls of the S port 26 may correspond to each other.

A length L1 between one end of the D port 25 and one end of the S port 26 is greater than or equal to a length L2 between the inlet 15 and the outlet 16. For example, the length L1 may be greater than or equal to the length L2 between the axis Li of the inlet 15 and the axis Lo of the outlet 16.

The D port 25 and the S port 26 may protrude from the center of the valve body 26 with respect to the axial direction A1 of the valve body 21. The C port 27 and the E port 28 may protrude on both sides of the S port 26. The C port 27 and the E port 28 may protrude in the same direction as the S port 26.

The four-way valve 20 may be arranged such that the center axis Ld of the D port 25 and the center axis Ls of the S port 26 are included in the plane P which includes the center axis Li of the inlet 15 and the center axis Lo of the outlet 16.

In other words, when the compressor 10 is viewed from above, the center axis Ld of the D port 25 and the center axis Ls of the S port 26 of the four-way valve 20 may correspond to the plane P including the center axis Li of the inlet 15 and the center axis Lo of the outlet 16.

Furthermore, the center axis Ld of the D port 25 and the center axis Ls of the S port 26 may form an angle with respect to the top face 17 of the compressor 10 such that the D port 25 is located higher than the S port 26. In this regard, the discharging pipe 40 and the sucking pipe 50 may each have two or less curves.

For example, the discharging pipe 40 may include two curves 44 and 45. Specifically, as shown in FIG. 4, the discharging pipe 40 may include a first linear pipe portion 41 coupled to the D port 25, a second linear pipe portion 42 coupled to the outlet 16, a third linear pipe portion 43 extending between the first and second linear pipe portions 41 and 42, a first curved pipe portion 44 connecting the first and third linear pipe portions 41 and 43, and a second curved pipe portion 45 connecting the second and third linear pipe portions 42 and 43.

In this case, the angle θ1 between the first linear pipe portion 41 and the top face 17 of the compressor 10 may be about 20 degrees to about 70 degrees to make it easy for the refrigerant to flow.

Figure 8:
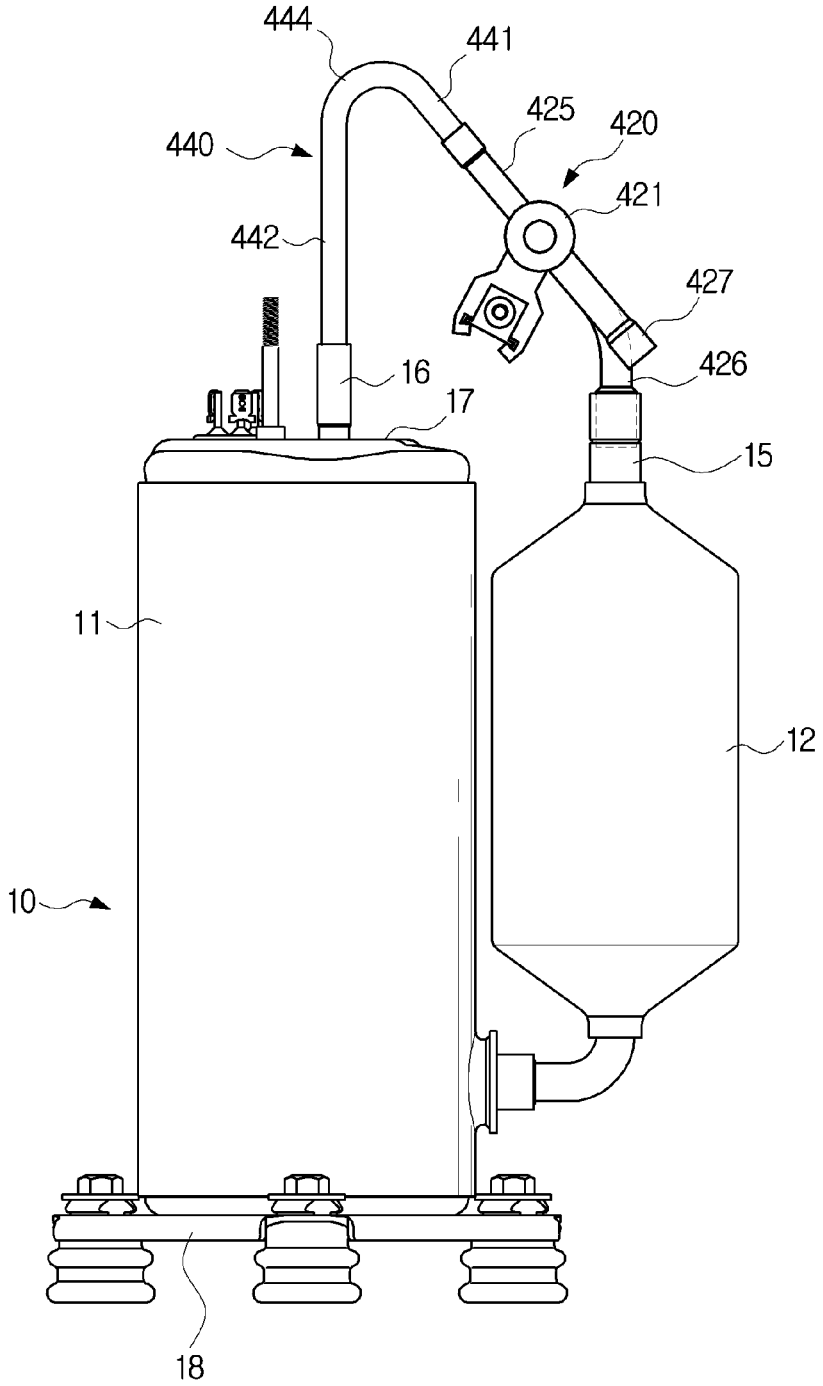
FIG. 8 is a side view of a piping structure connecting a compressor and a four-way valve, according to a fourth embodiment of the present disclosure.

Alternatively, the discharging pipe may be formed to have a single curve (see e.g., FIG. 8).

Furthermore, the sucking pipe 50 may be formed to have a single curve 53. Specifically, as shown in FIG. 4, the sucking pipe 50 may include a first linear pipe portion 51 coupled to the S port 26, a second linear pipe portion 52 coupled to the inlet 15, and a curved pipe portion 53 connecting the first and second linear pipe portions 51 and 52.

The first linear pipe portion 41 of the discharging pipe 40 and the first linear pipe portion 51 of the sucking pipe 50 have the same inclination, so that the angle θ1 between the first linear pipe portion 51 of the sucking pipe 50 and the top face 17 of the compressor 10 may be about 20 degrees to about 70 degrees.

As described above, the four-way valve 20 may be arranged such that the center axis Ld of the D port 25 and the center axis Ls of the S port 26 are included in the plane P including the center axis Li of the inlet 15 and the center axis Lo of the outlet 16; the four-way valve 20 may be arranged to form an angle with respect to the top face 17 of the compressor 10 such that the D port 25 is located higher than the S port 26; the discharging pipe 40 and the sucking pipe 50 are formed to each have two or less curves. As a result, the length of the compressor pipes 40 and 50 that connect the four-way valve 20 and the compressor 10 may be minimized and the four-way valve 20 may come close to the compressor 10. Furthermore, the minimized length of the compressor pipes 40, 50 and the four-way valve 20 coming close to the compressor 10 may make the natural frequency of the pipe have a higher frequency than the frequency of the operating range of the compressor 10, thereby preventing occurrence of resonance.

Figure 6:
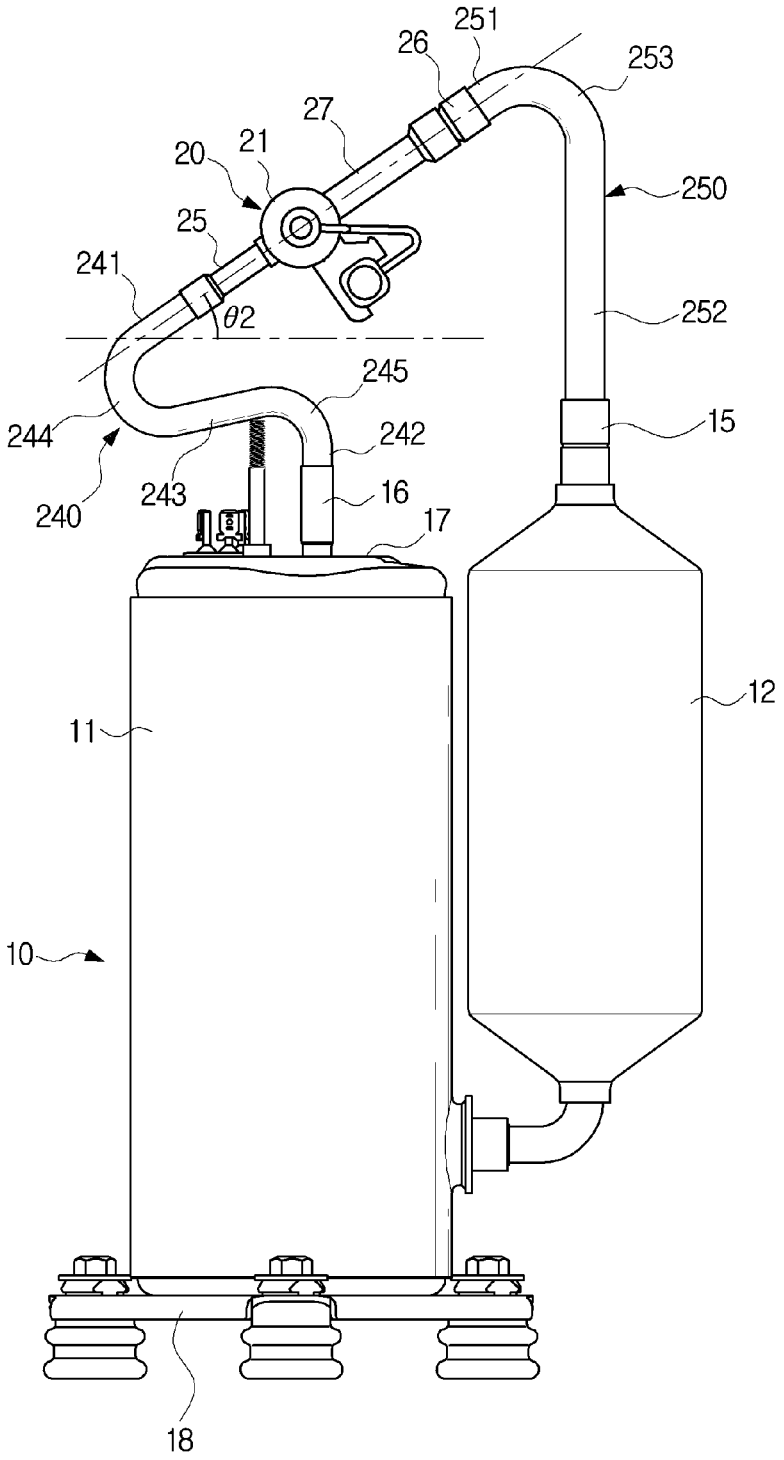
FIG. 6 is a side view of a piping structure connecting a compressor and a four-way valve, according to a second embodiment of the present disclosure.

FIG. 6 is a side view of a piping structure connecting a compressor and a four-way valve, according to a second embodiment of the present disclosure. For convenience of explanation, the outdoor heat exchanger pipe and the indoor heat exchanger pipe are omitted.

The same features as in the aforementioned embodiment are denoted by the same reference numerals, and the overlapping description will not be repeated.

Referring to FIG. 6, in a piping structure of the compressor and the four-way valve in accordance with the second embodiment of the present disclosure, the four-way valve 20 may be arranged such that the center axis Ld of the D port 25 and the center axis Ls of the S port 26 are included in plane P which includes the center axis Li of the inlet 15 and the center axis Lo of the outlet 16, as in the first embodiment.

However, a difference from the first embodiment is that the center axis Ld of the D port 25 and the center axis Ls of the S port 26 may form an angle with respect to the top face 17 of the compressor 10 such that the S port 26 is located higher than the D port 25, according to the difference in height between the compressor body 11 and the accumulator 12 or a spatial layout inside the outdoor unit 5.

The discharging pipe 240 may include two curves 244 and 245. Specifically, the discharging pipe 240 may include a first linear pipe portion 241 coupled to the D port 25, a second linear pipe portion 242 coupled to the outlet 16, a third linear pipe portion 243 extending between the first and second linear pipe portions 241 and 242, a first curved pipe portion 244 connecting the first and third linear pipe portions 241 and 243, and a second curved pipe portion 245 connecting the second and third linear pipe portions 242 and 243.

In this case, the angle θ2 between the first linear pipe portion 241 and the top face 17 of the compressor 10 may be about 20 degrees to about 70 degrees to make it easy for the refrigerant to flow.

The sucking pipe 250 may include a single curve 253. Specifically, the sucking pipe 250 may include a first linear pipe portion 251 coupled to the S port 26, a second linear pipe portion 252 coupled to the inlet 15, and a curved pipe portion 253 connecting the first and second linear pipe portions 251 and 252.

Figure 7:
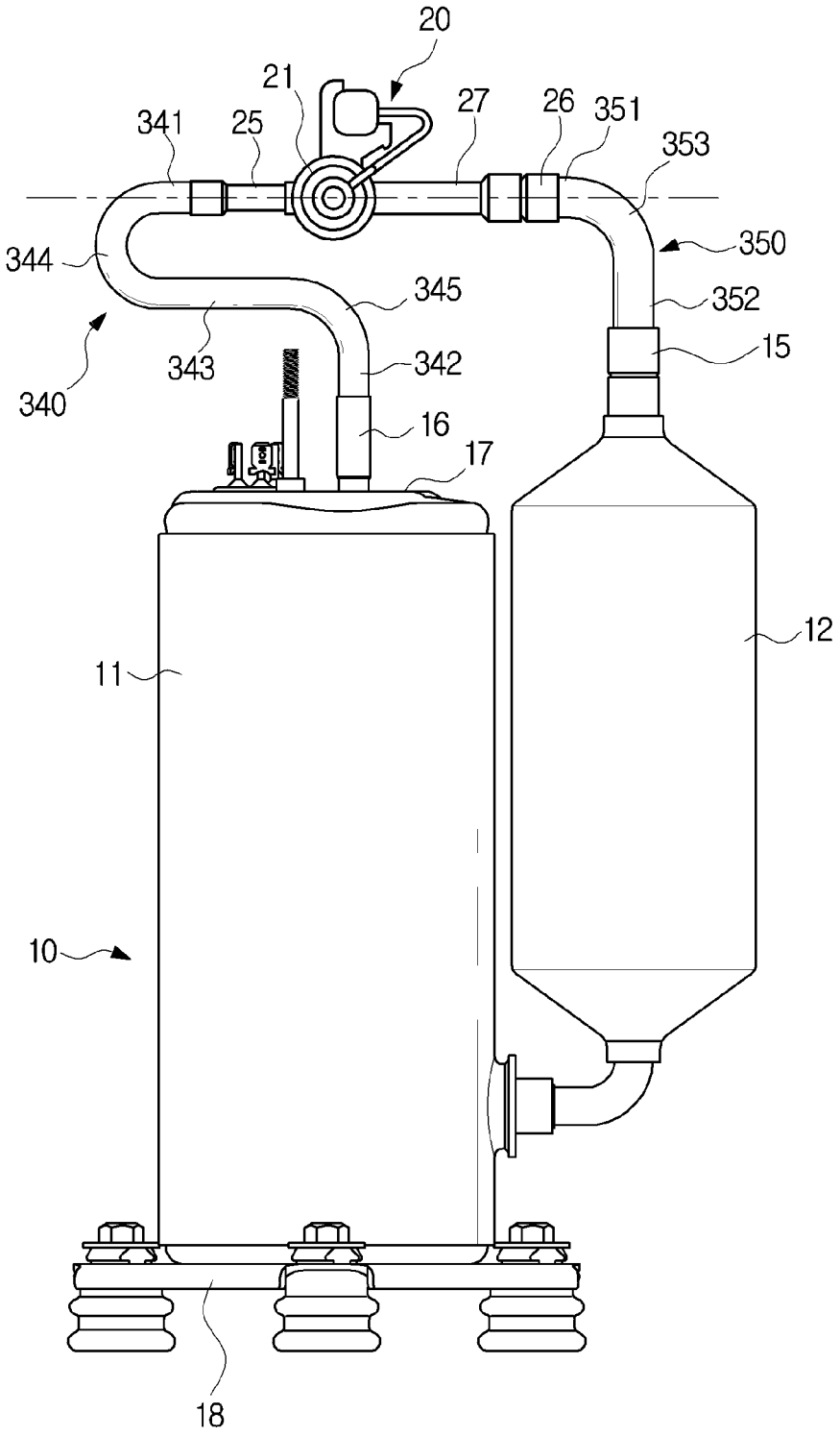
FIG. 7 is a side view of a piping structure connecting a compressor and a four-way valve, according to a third embodiment of the present disclosure.

FIG. 7 is a side view of a piping structure connecting a compressor and a four-way valve, according to a third embodiment of the present disclosure. For convenience of explanation, the outdoor heat exchanger pipe and the indoor heat exchanger pipe are omitted.

The same features as in the aforementioned embodiment are denoted by the same reference numerals, and the overlapping description will not be repeated.

Referring to FIG. 7, in a piping structure of the compressor and the four-way valve in accordance with the third embodiment of the present disclosure, the four-way valve 20 may be arranged such that the center axis Ld of the D port 25 and the center axis Ls of the S port 26 are included in the plane P which includes the center axis Li of the inlet 15 and the center axis Lo of the outlet 16, as in the first embodiment.

However, a difference from the previous embodiments is that the center axis Ld of the D port 25 and the center axis Ls of the S port 26 may run parallel to the top face 17 of the compressor 10 such that the S port 26 and the D port 25 are located on the matching level.

The discharging pipe 340 may include two curves 344 and 345. Specifically, the discharging pipe 340 may include a first linear pipe portion 341 coupled to the D port 25, a second linear pipe portion 342 coupled to the outlet 16, a third linear pipe portion 343 extending between the first and second linear pipe portions 341 and 342, a first curved pipe portion 344 connecting the first and third linear pipe portions 341 and 343, and a second curved pipe portion 345 connecting the second and third linear pipe portions 342 and 343.

The sucking pipe 350 may include a single curve 353. Specifically, the sucking pipe 350 may include a first linear pipe portion 351 coupled to the S port 26, a second linear pipe portion 352 coupled to the inlet 15, and a curved pipe portion 353 connecting the first and second linear pipe portions 351 and 352.

Figure 9:
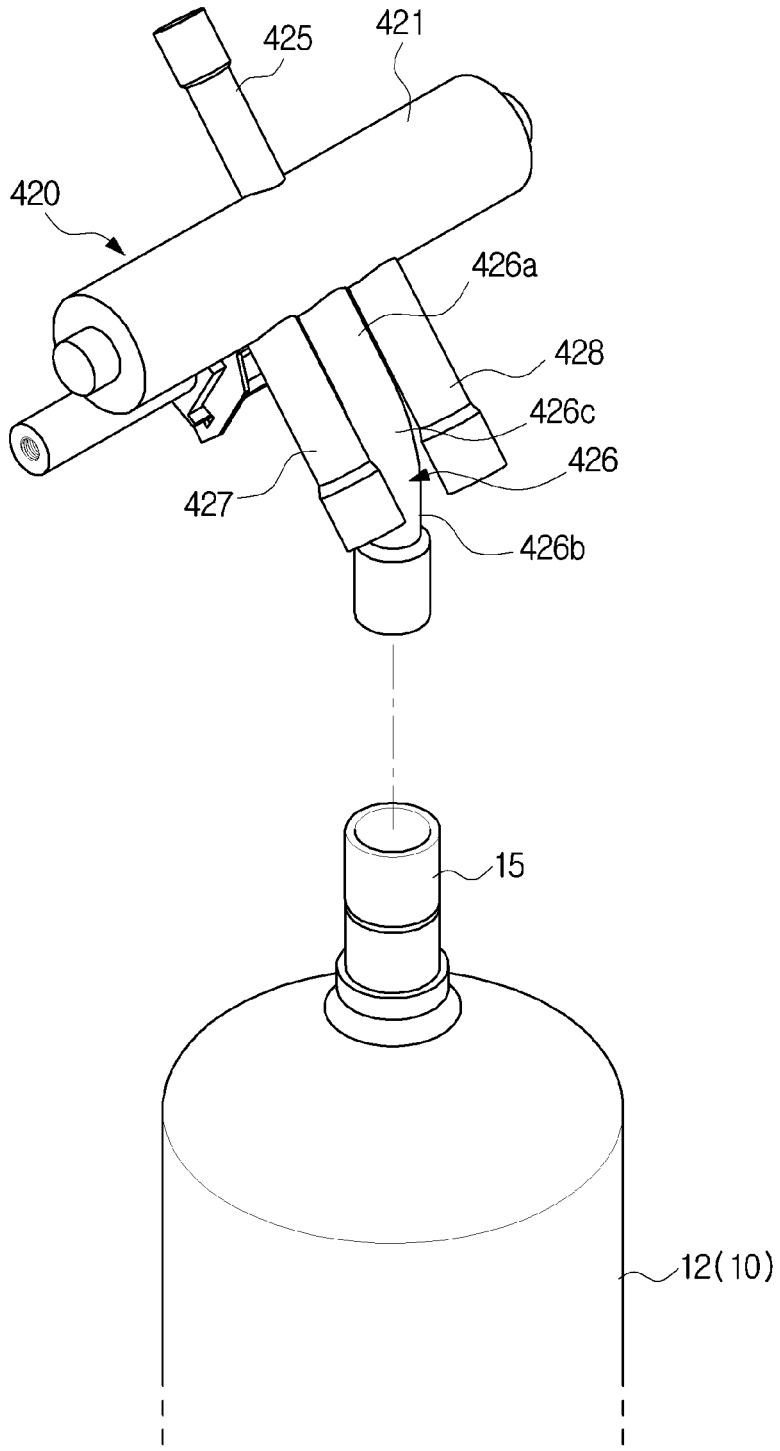
FIG. 9 is a perspective view of the four-way valve, according to the fourth embodiment of the present disclosure.
Figure 10:
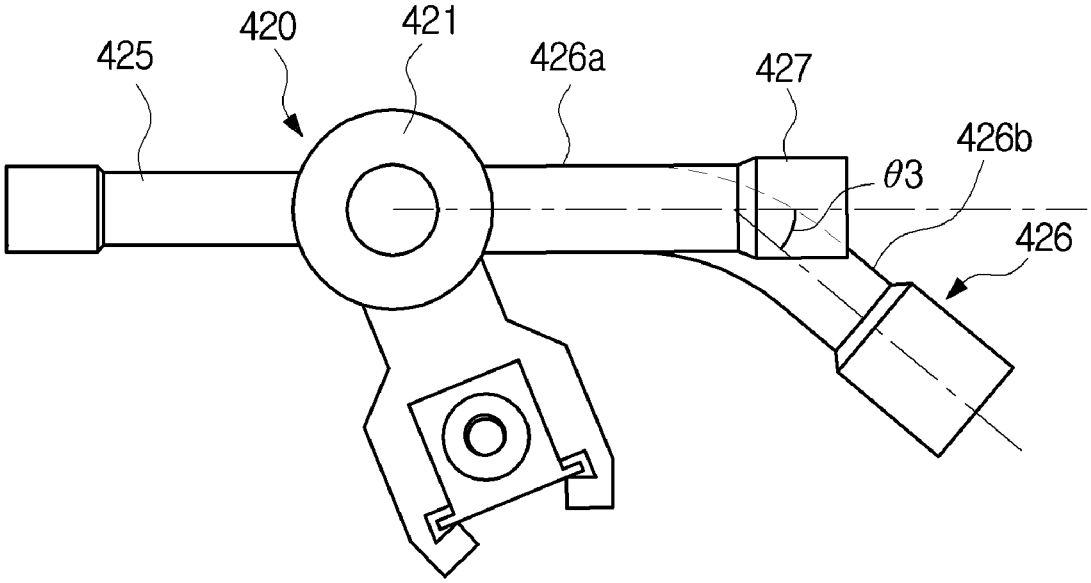
FIG. 10 is a side view of the four-way valve, according to the fourth embodiment of the present disclosure.

FIG. 8 is a side view of a piping structure connecting a compressor and a four-way valve, according to a fourth embodiment of the present disclosure. FIG. 9 is a perspective view of the four-way valve, according to the fourth embodiment of the present disclosure. FIG. 10 is a side view of the four-way valve, according to the fourth embodiment of the present disclosure. For convenience of explanation, the outdoor heat exchanger pipe and the indoor heat exchanger pipe are omitted in FIG. 8.

The same features as in the aforementioned embodiment are denoted by the same reference numerals, and the overlapping description will not be repeated.

Referring to FIGS. 8 to 10, unlike in the previous embodiments, an S port 426 of a four-way valve 420 may be formed to be directly coupled to the inlet 15.

Specifically, the four-way valve 420 may include a valve body 421 and four ports 425, 426, 427, and 428 protruding from the valve body 421. The four ports 425, 426, 427, and 428 may include a D port 425 formed to be coupled to the outlet 16 of the compressor 10, an S port 426 formed to be coupled to the inlet 15 of the compressor 10, a C port 427 formed to be coupled to the outdoor heat exchanger 6, and an E port 428 formed to be coupled to the indoor heat exchanger 3.

The S port 426 may include a first linear port portion 426*a* protruding from the valve body 421, a second linear port portion 426*b* formed to be coupled to the inlet 15, and a curved port portion 426*c* connecting the first and second linear port portions 426*a* and 426*b*. The angle θ3 between the first linear port portion 426*a* and the second linear port portion 426*c* may be about 20 degrees to about 90 degrees. The second linear port portion 426*b* may be inserted and coupled to the inlet 15 by e.g., welding. An expanded tube with expanded outer circumferential radius may be arranged at the end of the second linear port portion 426*b* to facilitate coupling with the inlet 15.

Figure 11:
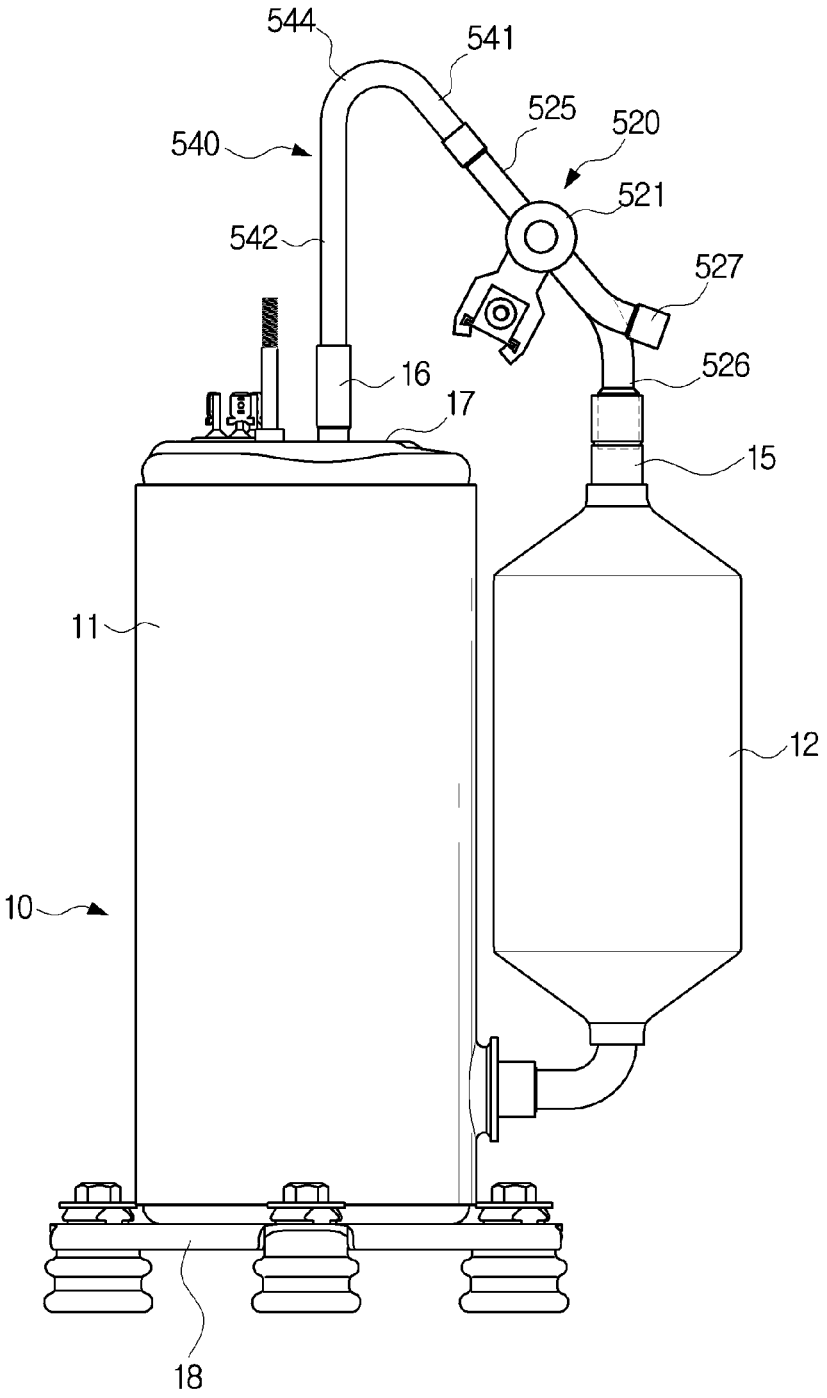
FIG. 11 is a side view of a piping structure connecting a compressor and a four-way valve, according to a fifth embodiment of the present disclosure.
Figure 12:
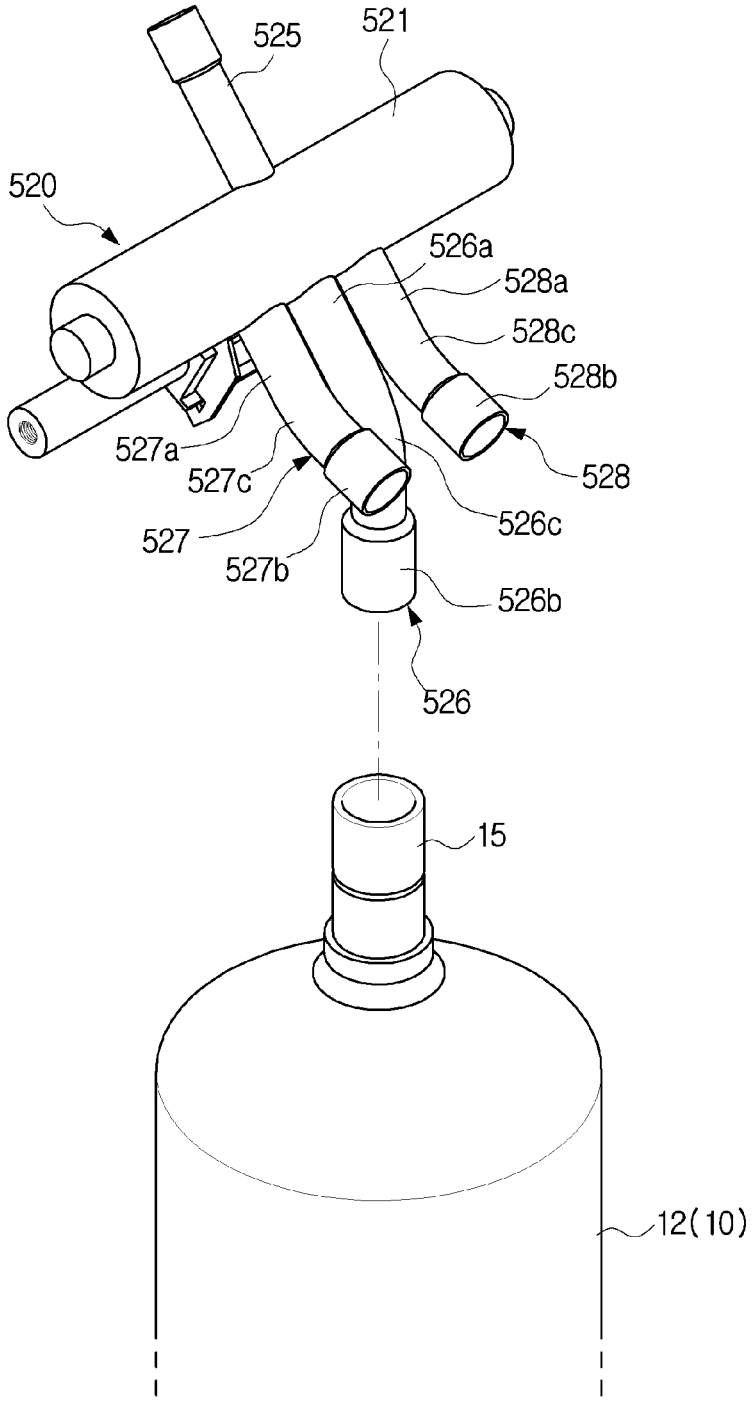
FIG. 12 is a perspective view of the four-way valve, according to the fifth embodiment of the present disclosure.
Figure 13:
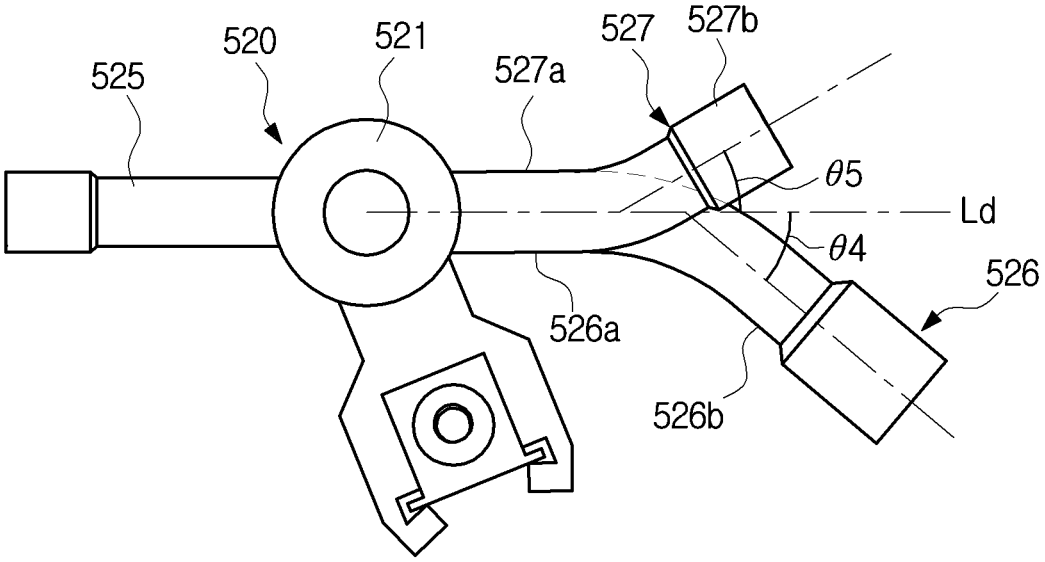
FIG. 13 is a side view of the four-way valve, according to the fifth embodiment of the present disclosure.

FIG. 11 is a side view of a piping structure connecting a compressor and a four-way valve, according to a fifth embodiment of the present disclosure. FIG. 12 is a perspective view of the four-way valve, according to the fifth embodiment of the present disclosure. FIG. 13 is a side view of the four-way valve, according to the fifth embodiment of the present disclosure. For convenience of explanation, the outdoor heat exchanger pipe and the indoor heat exchanger pipe are omitted in FIG. 11.

The same features as in the aforementioned embodiment are denoted by the same reference numerals, and the overlapping description will not be repeated.

Referring to FIGS. 11 to 13, an S port 526 of a four-way valve 520 may be bent and coupled directly to the inlet 15, and a C port 527 and an E port 528 of the four-way valve 520 may be bent toward an opposite direction of the S port 526.

Specifically, as shown in FIG. 13, from the center axis Ld of a D port 525, the S port 526 may be bent down by a certain angle θ4 and the C port 527 and the E port 528 may be bent up by a certain angle θ5. This is to facilitate welding of the pipes by minimizing interferences from the ports.

The four-way valve 520 may include the valve body 521 and four ports 525, 526, 527, and 528 protruding from the valve body 521. The four ports 525, 526, 527, and 528 may include a D port 525 formed to be coupled to the outlet 16 of the compressor 10, an S port 526 formed to be coupled to the inlet 15 of the compressor 10, a C port 527 formed to be coupled to the outdoor heat exchanger 6, and an E port 528 formed to be coupled to the indoor heat exchanger 3.

The S port 526 may include a first linear port portion 526*a* protruding from the valve body 521, a second linear port portion 526*b* formed to be coupled to the inlet 15, and a curved port portion 526*c* connecting the first and second linear port portions 526*a* and 526*b*. The second linear port portion 526*b* may be inserted and coupled to the inlet 15 by e.g., welding.

The C port 527 may include a fourth linear port portion 527*a* parallel to the first linear port portion 526*a*, a fifth linear port portion 527*b* formed to be coupled to the outdoor heat exchanger pipe 60, and a second curved port portion 527*c* connecting the fourth and fifth linear port portions 527*a* and 527*b*. The second curved port portion 527*c* may be bent in the opposite direction of the curved port portion 526*c*.

The E port 528 may include a fourth linear port portion 528*a* parallel to the first linear port portion 526*a*, a fifth linear port portion 528*b* formed to be coupled to the indoor heat exchanger pipe 70, and a second curved port portion 528*c* connecting the fourth and fifth linear port portions 528*a* and 528*b*. The second curved port portion 528*c* may be bent in the opposite direction of the curved port portion 526*c*.

Figure 14:
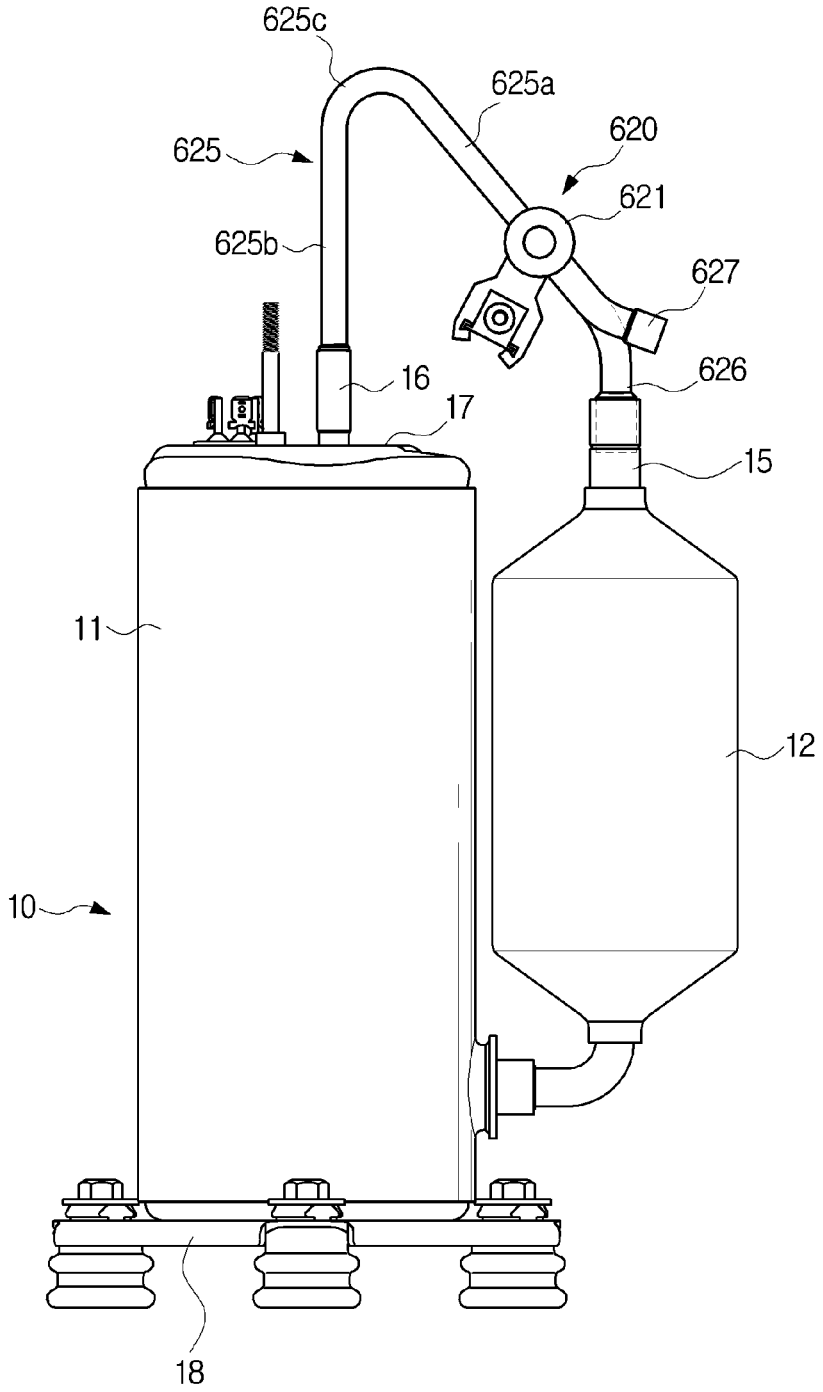
FIG. 14 is a side view of a piping structure connecting a compressor and a four-way valve, according to a sixth embodiment of the present disclosure.
Figure 15:
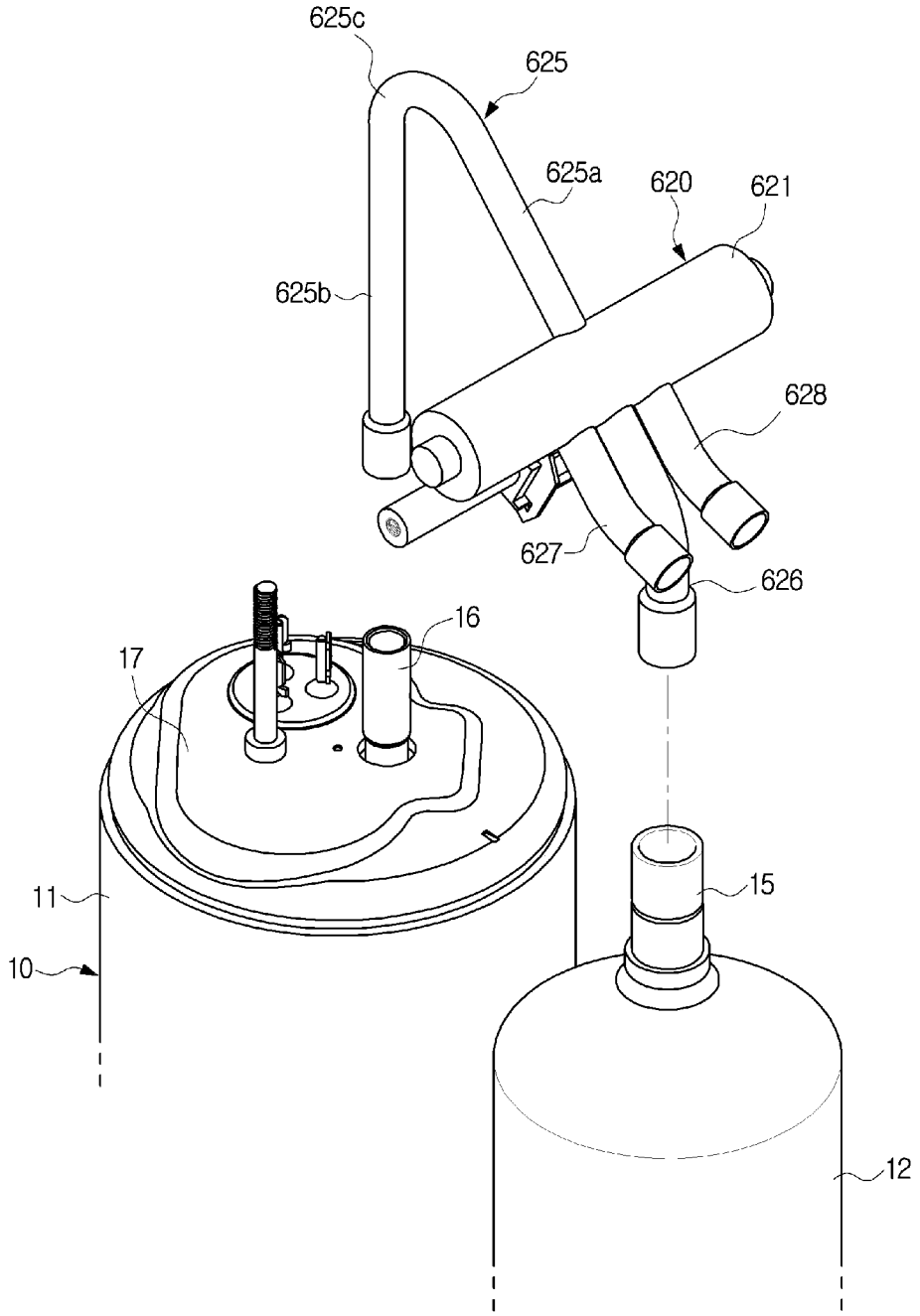
FIG. 15 is a perspective view of the four-way valve, according to the sixth embodiment of the present disclosure.

FIG. 14 is a side view of a piping structure connecting a compressor and a four-way valve, according to a sixth embodiment of the present disclosure. FIG. 15 is a perspective view of the four-way valve, according to the sixth embodiment of the present disclosure. For convenience of explanation, the outdoor heat exchanger pipe and the indoor heat exchanger pipe are omitted in FIG. 14.

The same features as in the aforementioned embodiment are denoted by the same reference numerals, and the overlapping description will not be repeated.

Referring to FIGS. 14 to 15, a D port 625 of a four-way valve 620 may be formed to be directly coupled to the outlet 16.

Specifically, the four-way valve 620 may include a valve body 621 and four ports 625, 626, 627, and 628 protruding from the valve body 621. The four ports 625, 626, 627, and 628 may include a D port 625 formed to be coupled to the outlet 16 of the compressor 10, an S port 626 formed to be coupled to the inlet 15 of the compressor 10, a C port 627 formed to be coupled to the outdoor heat exchanger 6, and an E port 628 formed to be coupled to the indoor heat exchanger 2.

The D port 625 may include a first linear port portion 625*a* protruding from the valve body 621, a second linear port portion 625*b* formed to be coupled to the outlet 16, and a curved port portion 625*c* connecting the first and second linear port portions 625*a* and 625*b*. An expanded tube with expanded outer circumferential radius may be arranged at the end of the second linear port portion 625*b* to facilitate coupling with the outlet 16.

The second linear port portion 626*b* may be inserted and coupled to the outlet 16 by e.g., welding.

Figure 16:
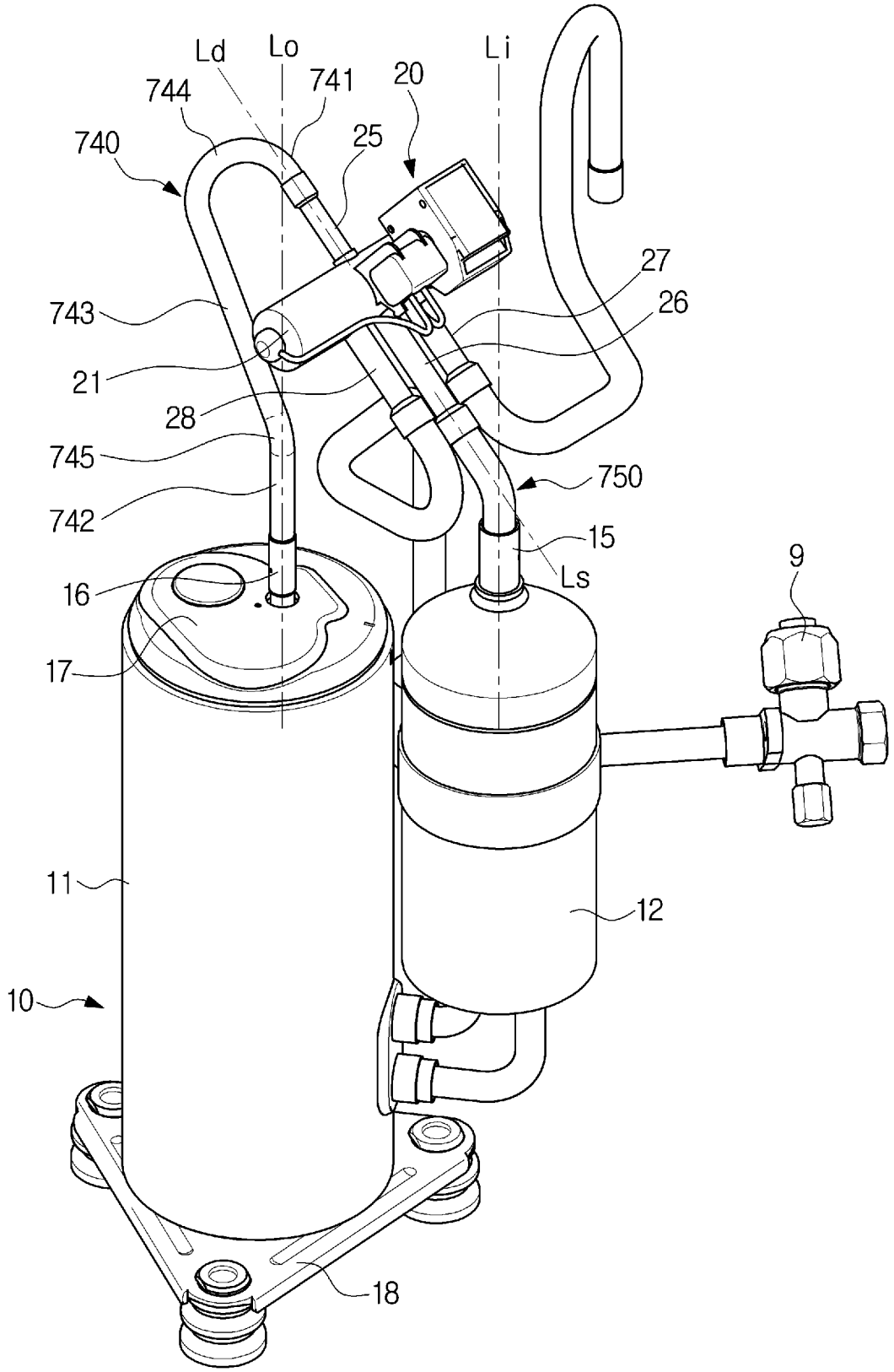
FIG. 16 is a perspective view of a piping structure connecting a compressor and a four-way valve, according to a seventh embodiment of the present disclosure.
Figure 17:
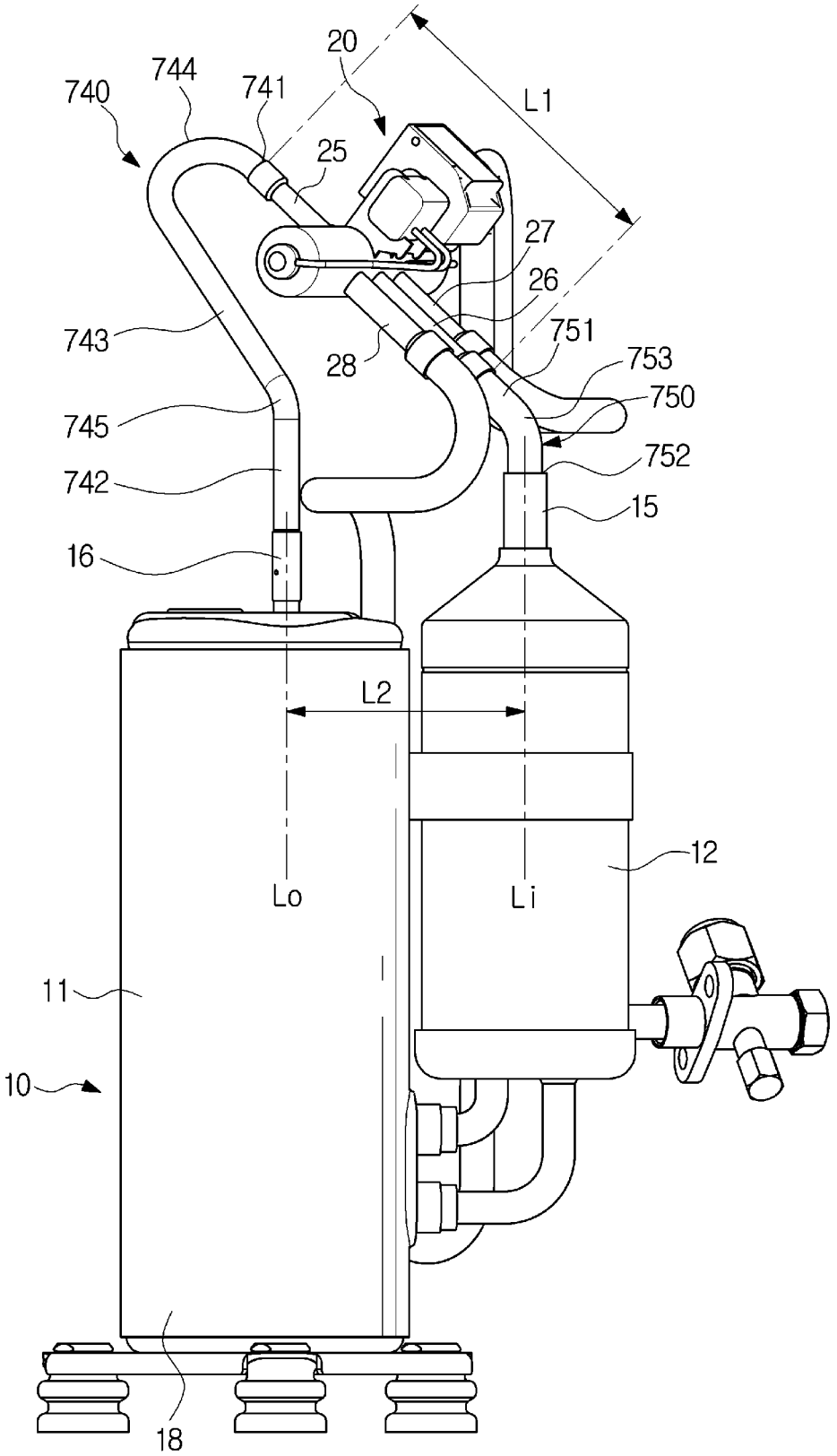
FIG. 17 is a side view of a piping structure connecting a compressor and a four-way valve, according to the seventh embodiment of the present disclosure.
Figure 18:
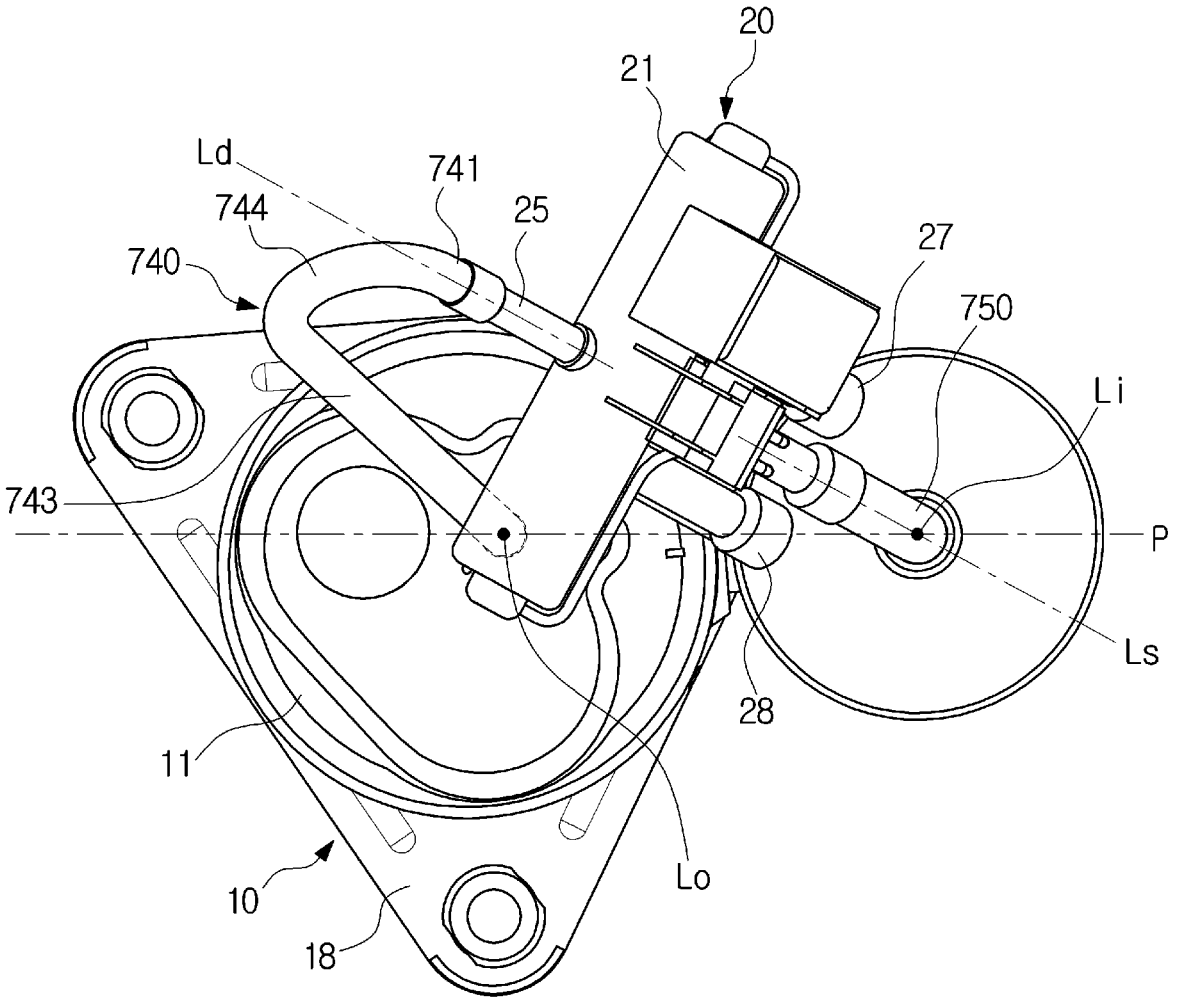
FIG. 18 is a plane view of a piping structure connecting a compressor and a four-way valve, according to the seventh embodiment of the present disclosure.

Although the D port 625 is directly coupled to the outlet 16 and the S port 626 is directly coupled to the inlet 15 in FIGS. 14 and 15, the present disclosure is not limited thereto. For example, only the D port 625 is directly coupled to the outlet 16 and the S port 626 is coupled to the inlet 15 through the pipe in some other embodiments. FIG. 16 is a perspective view of a piping structure connecting a compressor and a four-way valve, according to the seventh embodiment of the present disclosure. FIG. 17 is a side view of a piping structure connecting a compressor and a four-way valve, according to the seventh embodiment of the present disclosure. FIG. 18 is a plane view of a piping structure connecting a compressor and a four-way valve, according to the seventh embodiment of the present disclosure.

Referring to FIGS. 16 to 18, a piping structure connecting a compressor and a four-way valve will be described, according to another embodiment of the present disclosure. The same features as in the aforementioned embodiment are denoted by the same reference numerals, and the overlapping description will not be repeated.

The piping structure connecting a compressor and a four-way valve in accordance with the seventh embodiment of the present disclosure is the same as the piping structure of FIG. 3 as described above, except that the center axis Ld of the D port 25 and the center axis Ls of the S port 26 are formed at an angle with the plane P which includes the center axis Li of the inlet 15 and the center axis Lo of the outlet 16.

Specifically, the four-way valve 20 may be slantingly arranged such that the center axis Ld of the D port 25 and the center axis Ls of the S port 26 are not included in the plane P which includes the center axis Li of the inlet 15 and the center axis Lo of the outlet 16.

The discharging pipe 740 may include two curves 744 and 745. Specifically, the discharging pipe 740 may include a first linear pipe portion 741 coupled to the D port 25, a second linear pipe portion 742 coupled to the outlet 16, a third linear pipe portion 743 extending between the first linear pipe portion 741 and the second linear pipe portion 742, a first curved pipe portion 744 connecting the first linear pipe portion 741 and the third linear pipe portion 743, and a second curved pipe portion 745 connecting the second linear pipe portion 742 and the third linear pipe portion 743.

The sucking pipe 750 may be formed to have a single curve 753. Specifically, the sucking pipe 750 may include a first linear pipe portion 751 coupled to the S port 26, a second linear pipe portion 752 coupled to the inlet 15, and a curved pipe portion 753 connecting the first linear pipe portion 751 and the second linear pipe portion 752.

With the aforementioned structure, the length of the discharging pipe 740 and the length of the sucking pipe 750 connecting the four-way valve 20 and the compressor 10 may be minimized and the four-way valve 20 may come close to the compressor 10. Furthermore, the minimized length of the discharging pipe 740 and the minimized length of the sucking pipe 750 and the four-way valve 20 coming close to the compressor 10 may make the natural frequency of the pipe have a higher frequency than the frequency of the operating range of the compressor 10, thereby preventing occurrence of resonance. In other words, the compressor 10 and the four-way valve 20 may show a joint movement property.

Furthermore, with the four-way valve 20 slantingly arranged such that the center axis Ld of the D port 25 and the center axis Ls of the S port 26 are not included in the plane P which includes the center axis Li of the inlet 15 and the center axis Lo of the outlet 16, the joint movement property of the four-way valve 20 and compressor 20 remains and interference with surrounding structures such as a control box or a reactor may be avoided.

According to embodiments of the present disclosure, a four-way valve may be connected closely or directly to the compressor to shift the natural frequency of the pipe out of the operating range of the compressor, thereby securing reliability of cohesion of the pipe.

According to embodiments of the present disclosure, a four-way valve may be connected closely or directly to the compressor to shift the natural frequency of the pipe out of the operating range of the compressor, thereby securing reliability of cohesion of the pipe.

According to embodiments of the present disclosure, the length of the pipe is minimized, thereby reducing material costs and attaining a compact compressor room.

According to embodiments of the present disclosure, a four-way valve may be properly arranged not to interfere with surrounding structures, such as a control box or a reactor while having a property of joint movement with a compressor.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. An air conditioner comprising:

a compressor having an accumulator having an inlet through which a refrigerant is sucked in and filtered in the accumulator, and a compressor body in which the sucked refrigerant is compressed, the compressor body having an outlet through which the compressed refrigerant is discharged;

a four-way valve configured to switch flow paths in a cooling operation and a heating operation, the four-way valve having a valve body, a D port protruding from the valve body in a first direction, and an S port protruding from the valve body in a second direction which is opposite of the first direction;

a discharging pipe to connect the outlet and the D port; and a sucking pipe to connect the inlet and the S port, wherein one of the discharging pipe and the sucking pipe has two curved portions and an other one of the discharging pipe and the sucking pipe has one curved portion, and the first direction and the second direction are inclined with respect to a top face of the compressor body, and wherein a center axis of the D port and a center axis of the S port are formed at an angle with respect to a plane including a center axis of the inlet and a center axis of the outlet.

2. The air conditioner of claim 1, wherein a center axis of the inlet and a center axis of the outlet are parallel to each other.

3. The air conditioner of claim 1, wherein a center axis of the D port and a center axis of the S port correspond to each other.

4. The air conditioner of claim 3, wherein the D port and the S port respectively protrude from a center portion of the valve body.

5. The air conditioner of claim 1, wherein the valve body has a cylindrical shape, and the D port and the S port protrude in directions perpendicular to an axial direction of the valve body.

6. The air conditioner of claim 1, wherein the four-way valve is slantingly arranged such that the D port is positioned higher than the S port.

7. The air conditioner of claim 1, wherein the discharging pipe comprises a first linear pipe portion coupled to the D port, a second linear pipe portion coupled to the outlet, a third linear pipe portion extending between the first linear pipe portion and the second linear pipe portion, a first curved pipe portion to connect the first and third linear pipe portions, and a second curved pipe portion to connect the second and third linear pipe portions.

8. The air conditioner of claim 1, wherein the sucking pipe comprises a first linear pipe portion coupled to the S port, a second linear pipe portion coupled to the inlet, and a curved pipe portion to connect the first linear pipe portion and the second linear pipe portion.

9. The air conditioner of claim 1, wherein the four-way valve is slantingly arranged such that the S port is positioned higher than the D port.

10. The air conditioner of claim 1, wherein the S port and the D port are positioned at a corresponding height.

11. The air conditioner of claim 1, wherein an angle between the first direction and the top face of the compressor is about 20 degrees to about 70 degrees.

12. An air conditioner comprising:

a compressor having an accumulator having an inlet through which a refrigerant is sucked in and filtered in the accumulator, and a compressor body in which the sucked refrigerant is compressed, the compressor body having an outlet through which the compressed refrigerant is discharged;

an outdoor heat exchanger;

an indoor heat exchanger; and a four-way valve configured to switch flow paths in a cooling operation and a heating operation, the four-way valve having a valve body, a D port protruding from the valve body and directly coupled to the outlet, an S port protruding from the valve body and directly coupled to the inlet, a C port protruding from the valve body and coupled to the outdoor heat exchanger, and an E port protruding from the valve body and coupled to the indoor heat exchanger, wherein a length between the D port and the S port is greater than or equal to a length between the outlet and the inlet, the D port is protruding from the valve body in a first direction, the S port is protruding from the valve body in a second direction opposite of the first direction, and the first direction and the second direction are inclined with respect to a top face of the compressor body, and wherein a center axis of the D port and a center axis of the S port are formed at an angle with respect to a plane including a center axis of the inlet and a center axis of the outlet.

13. The air conditioner of claim 12, wherein the S port is directly inserted and coupled to the inlet.

14. The air conditioner of claim 13, wherein the four-way valve comprises a valve body having a cylindrical shape, wherein the D port protrudes in a first direction, which is perpendicular to an axial direction of the valve body, and wherein the S port comprises a first linear port portion protruding in a second direction opposite to the first direction, a second linear port portion coupled to the inlet, and a curved port portion to connect the first and second linear port portions.

15. The air conditioner of claim 14, wherein the first linear port portion and the second linear port portion form an angle of about 20 degrees to about 90 degrees.

16. The air conditioner of claim 14, further comprising:

an outdoor heat exchanger pipe to connect the outdoor heat exchanger and the C port, wherein the C port comprises a fourth linear port portion parallel to the first linear port portion, a fifth linear port portion coupled to the outdoor heat exchanger pipe, and a second curved port portion to connect the fourth linear port portion and the fifth linear port portion, and wherein the second curved port portion is bent in an opposite direction of the curved port portion.

17. The air conditioner of claim 14, further comprising: an indoor heat exchanger pipe to connect the indoor heat exchanger and the E port, wherein the E port comprises a fourth linear port portion parallel to the first linear port portion, a fifth linear port portion coupled to the indoor heat exchanger pipe, and a second curved port portion to connect the fourth linear port portion and the fifth linear port portion, and wherein the second curved port portion is bent in an opposite direction of the curved port portion.

18. The air conditioner of claim 12, wherein the D port is directly inserted and coupled to the outlet.

19. The air conditioner of claim 18, wherein the four-way valve comprises a valve body having a cylindrical shape, wherein the D port comprises a first linear port portion protruding in a first direction perpendicular to an axial direction of the valve body, a second linear port portion coupled to the outlet, and a curved port portion to connect the first linear port portion and the second linear port portion.

20. The air conditioner of claim 12, wherein an angle between the first direction and the top face of the compressor is about 20 degrees to about 70 degrees.

* * * * *